US006189455B1

(12) United States Patent
Thompson

(10) Patent No.: US 6,189,455 B1
(45) Date of Patent: Feb. 20, 2001

(54) TRANSPORT APPARATUS

(75) Inventor: Jeffrey A. Thompson, New Bern, NC (US)

(73) Assignee: JTA, Inc., Plainfield, IN (US)

( * ) Notice: Under 35 U.S.C. 154(b), the term of this patent shall be extended for 0 days.

(21) Appl. No.: 09/265,461

(22) Filed: Mar. 10, 1999

(51) Int. Cl.[7] ..... B61D 7/00

(52) U.S. Cl. ..... 104/112; 104/117; 104/173.1; 104/126; 212/179; 182/73; 182/84; 254/390

(58) Field of Search ..... 104/112, 114, 104/117, 173.1, 183, 126; 212/179, 76; 182/101, 70, 73, 42, 84, 82, 37, 43; 254/390, 264

(56) References Cited

U.S. PATENT DOCUMENTS

| | | | | |
|---|---|---|---|---|
| 980,330 | * | 1/1911 | Olander | 182/101 |
| 3,221,666 | * | 12/1965 | Wengel | 104/173.1 |
| 3,531,000 | | 9/1970 | Rennie et al. . | |
| 3,713,547 | * | 1/1973 | Beck | 214/2.5 |
| 3,951,232 | | 4/1976 | Okada . | |
| 4,054,210 | | 10/1977 | Crocker . | |
| 4,256,199 | | 3/1981 | Sellards . | |
| 4,865,155 | | 9/1989 | Montaigne et al. . | |
| 5,135,119 | | 8/1992 | Larkin . | |
| 5,497,855 | | 3/1996 | Moore . | |
| 5,622,237 | * | 4/1997 | Moldow | 182/37 |
| 5,653,350 | | 8/1997 | Maki . | |

* cited by examiner

*Primary Examiner*—Russell D. Stormer
*Assistant Examiner*—Frantz F. Jules
(74) *Attorney, Agent, or Firm*—Rhodes & Mason, PLLC

(57) ABSTRACT

An easily carried and assembled apparatus for use in moving materials between two elevated locations, such as windows of spaced building, that includes a sending assembly positionable across a window in a first building, and a receiving assembly positioned across the window in the second building. Each assembly included a pair of triangular bracing members with bases that are positioned against the interior of the wall on either side of the opening, and a crossbar that is attached at its ends to the apexes of the bracing members, and extends across the opening. A cable is stretched between the assemblies, and a material support is used to carry materials along the cable between the buildings. The apparatus may be combined with a vertical lifting assembly that is attachable within a wall opening in one of the buildings. The vertical lifting assembly includes a lifting bar with an inner end and an outer end having a line guide inner and outer clamping bars positionable on opposite sides of the opening in the building wall, connectors for joining the lifting bar transversely to the clamping bars; and clamps to hold the clamping bars against the wall.

24 Claims, 4 Drawing Sheets

Fig. 5-A

TRANSPORT APPARATUS

BACKGROUND OF THE INVENTION (1) Field of the Invention

The present invention relates generally to a material transfer apparatus and in particular to a portable and readily deployable device for moving goods or personnel along a generally horizontal pathway and/or a vertical pathway.

(2) Description of the Prior Art

Movement of materials between to locations has been previously accomplished by extending a rope or cable from one location to the other, and moving the objects along the rope or cable with a pulley supported on the rope or cable. Objects have also been lifted vertically by attaching a pulley to a bar or beam that extends over the object to be lifted, and running a rope or cable through the pulley and down to the object.

Prior art devices, however, are not suitable for some conditions where the transport of objects or personnel is necessary, either because the setup of the device is too time consuming, because the device is inadequate to support the weight of the goods being transported, or because the setup or design of the device would expose the operating personnel to undue risk.

For example, during urban warfare it is desirable to transport materials between elevated openings, e.g., windows or doors, of two buildings that are spaced apart by as much as 100 yards and occupied by friendly forces. Not only must the apparatus be easy to transport into the buildings, it must also be designed to be set up quickly, and be of sufficient durability to transport the desired materials over the distance between the buildings.

Also, the personnel operating the device must not be unduly exposed to hostile fire or environmental hazards during use of the device. These requirements also apply to devices used by other organizations, such as SWAT teams, and by fire and rescue personnel.

SUMMARY OF THE INVENTION

The present invention is directed to devices for use in transporting materials between two points, and in particular to collapsible devices that can be easily carried by an individual to the area of intended use. These devices can be used for substantially horizontal transport of materials, for vertical lifting or lowering of materials, or in combination for both purposes.

One device within the scope of the invention, described herein for convenience as the "primary device," is a portable, collapsible device for transporting materials between two generally horizontal elevated locations. This primary device may also be configured for use as a vertical transport device, or combined with a separate vertical transport device, referred to herein for convenience as the "secondary device," so that materials can be vertically lifted to a given position and then transported along an elevated, substantially horizontal pathway, or first transported horizontally and then lowered with the second device. The term "horizontal pathway" is intended to describe a pathway within about 30° of horizontal.

The primary device and its use will be described in the context of the transportation of materials between opening, e.g., windows or doors, on the facing sides of two adjacent multi-story buildings. It will be understood after reading of the description of the invention, however, that the primary device will find uses in other situations where there is a need to transfer materials between two elevated locations. Also, while the primary device and the secondary device are described in the context of transporting materials, it will be understood that the devices can also be used to transport personnel.

The primary device finds particular utility in hostile situations, such as those encountered by military personnel or SWAT teams, where there is a need to move materials between to elevated locations under circumstances where the personnel engaging in the transport ofthe materials could be fired upon by adversaries. The device also finds utility by firefighters in the moving of materials either to or from a burning building, or another building in the immediate vicinity of the burning building. Other uses will be apparent from a reading of the description.

The primary device is comprised of a sending assembly to be positioned at a first location, and a receiving assembly to be positioned at a second location. It will become apparent that the terms "sending" and "receiving" refers to the manner of deployment of the assemblies, and that material can be transported between the assemblies in either direction.

The sending assembly is comprised of a first collapsible framework to span the opening at the first location, and a cable-carrying winch supported on the framework. The receiving assembly is comprised of a second collapsible framework to span the opening at the second location, and an attachment means on the second framework for attachment of the distal end of a cable extending from the winch on the first assembly. In addition, the apparatus includes a snatch block pulley for use in supporting material along the cable, and lines attached to the pulley for pulling the pulley in either direction. Separate containers or bags are provided for packing and transport of the sending and receiving assemblies.

In order to be suitable for its intended purposes, the above device must meet certain requirements. First, each assembly must be easily transportable by one person, since it may be necessary to man-pack each unit up several stories of a building, often under adverse conditions.

Second, each assembly must be easily and quickly assembled, since time is likely to be of the essence, and the conditions under which the device is assembled are likely to be far less than ideal. Preferably, it should be possible to assembly each unit in less than two minutes. Third, the construction of the unit must be such that a load of up to about 300 pounds can be transported between two locations that are as much as 100 feet apart. Fourth, and of critical importance, the device must be constructed so that operating personnel are not exposed to danger during use.

The frameworks of the send and receive assemblies are ideally of the same construction for economic reasons, and for interchangeability of parts. Generally, each framework is comprised of a pair of brace members for placement on either side of an opening, e.g., a window, and a crossbar spanning the opening and joining the two brace members together.

The brace member is preferably of a triangular configuration, with a central base to be positioned against the inner face of a wall on one side of an opening, and first and second hinged legs at each end of the base. Each leg includes an inner end pivotally attached adjacent one end of the base, and an outer end.

Preferably, the inner end of one leg is attached, e.g., with a releasable pin, so that the leg can be folded against the base, with the other leg attached so that the leg can be folded against the exterior of the second leg. Thus, when the brace member is folded, the base and legs are adjacent each other and parallel, thereby forming a compact unit. One or both attachment pins can be readily removable for ease of assembling the brace member.

A connector cap is used to connect the outer ends of the legs. The cap preferably includes sockets into which the distal ends of the legs are fitted, with removable pins being inserted through the socket wall and each leg to hold the leg in the socket. The crossbar is preferably slidably inserted into an opening or bore in the cap. A removable pin is also used to hold the connecting member and brace member in the desired position.

The crossbar is basically a bar that is inserted through the connector caps of each brace member. The length of the bar is preferably longer than the width of the opening to be spanned. Since the assembly is likely to be used with openings of different size, the connecting member is slidable within the opening of the caps. The crossbar may be a one-piece bar, or two or more bars that are joined together at their adjacent ends by a connector to form a bar of the desired length. A telescoping bar formed of a plurality of nesting segments may also be used.

The crossbar includes a plurality of spaced holes to receive the connecting pins inserted through the caps and into the bar. These openings are also used to attach the cabled-winch assembly to the sending assembly crossbar, and the cable attachment unit to the crossbar of the receiving assembly.

The winch attached to the sending assembly crossbar is comprised of a bar attachment frame, a cable spool rotatably mounted on the attachment frame, a drive gear operatively connected to the spool and turned by a handle to rotate the spool, and a spool lock to engage and hold the spool at the desired position. A cable is wound onto the winch spool.

The winch's bar attachment frame is preferably comprised of a bar attachment member, such as an elongated tubular member through which the bar is inserted, and a spool mounting plate attached to the bar attachment member. The bar attachment member includes a plurality of holes alignable with the holes in the bar, so that the winch can be releasibly secured to the bar at selected points along its length.

The cable attachment unit forming part of the receiving assembly is comprised of a crossbar attachment frame of a similar construction, i.e., a bar attachment member and a cable eyebolt or attachment unit attached to the bar attachment member. The bar attachment member is also preferably of a tubular element slidable on the bar, with holes in the wall of the tubular element alignable with holes in the bar, so that the cable attachment eye can be positioned at selected points along the bar length.

The snatch block pulley is of conventional design, and includes a pulley to ride along the cable between the sending and receiving assemblies, a hook or eyebolt for attaching lines that extend to the assemblies to pull the pulley in either direction, and a lower hook for attaching material to be transported.

When used to transport materials between two buildings, the sending assembly is carried in a bag or other container to a window or other opening in the wall of the first building. Each brace member is assembled by connecting the inner ends of the legs to the ends of the base and the outer ends of the legs to the cap. The crossbar is then inserted through the caps of each brace member, and adjusted so that the distance between the brace members is greater that the width of the wall opening. The winch is mounted at the desired location on the crossbar. After assembly, one brace member is then placed on either side of the opening, with the crossbar extending horizontally across the opening. In this position, the crossbar and winch are positioned at a distance to the rear of the opening, limiting exposure of operating personnel.

The receiving assembly is assembled in the same manner, except that the cable attachment unit is mounted on the crossbar of the receiving member in a desired position. One brace member of the receiving assembly is placed on either side of the opening at the second location, with the crossbar being positioned horizontally across the opening. When traversing at horizontal or vertical offset angles, the sending and receiving units can be positioned vertically, horizontally, or any position in between, to give a direct pull in the direction of movement.

A line attached to the cable and the pulley line is then projected from the first location to the second location, e.g., by the use of a crossbow. Personnel at the second location pull on the line to draw the ends of the cable and pulley line to the second location. After attachment of the cable end to the attachment unit, the winch is used to tighten the cable between the locations, thereby forming a cable trackway for the pulley, as well as securing the brace members against the walls at each location. The pulley is then drawn to the location from which the materials to be sent. The materials are attached to the pulley hook, and personnel at the other location pull on their pulley line to move the materials to their location. The dispatching personnel can then pull on their line to return the pulley for transport of additional material.

One of the above assemblies can also be used alone to raise or lower material in a vertical direction. For this purpose, a pair of brace members and one of the bars can be assembled as discussed above, with one of the brace members being placed over the location from which material is to be raised or into which material is to be lowered, e.g., a hole or well. One brace member is placed on either side of the location, with the bar being positioned horizontally across the opening.

If only light weight material is to be raised or lowered, the pulley can be attached to the attachment unit, and rope or line inserted through the pulley, so that one end extends downward, while the other end is used to pull or lower material. However, if heavier material is to be transported, the winch can be attached to the bar, and the cable extended downward. The winch can be mounted at one end of the bar, with the cable being extended through the centrally mounted attachment unit or pulley. In this manner, the operating personnel can stand to one side of the location which operating the device.

Some vertical raising or lifting of materials may be on uneven terrain. In this event, the assembly may also include telescoping leg extensions that can be joined to the inner ends of the legs, after removal of the base members, and adjusted to different lengths to compensate for different terrain levels. These leg extensions may be carried in either bag. Pivotal feet can be attached to the bottom of the leg extensions to adjust for surfaces that are not horizontal. The legs or leg extensions can also be connected by a horizontal bar to provide additional stability.

Normally, the leg extensions will have an inside diameter approximately equal to the outside diameter of the legs, so that the extensions can be telescoped over the legs. The legs and leg extensions will include locking means to secure the legs and extensions at the desired telescoped length. For example, the legs and extensions may include holes, and pins attached to a spreader bar insertable though holes that align and stabilize at the desired extension.

Under some circumstances, it will be desirable to include a vertical lift assembly of a different construction along with the receiving and/or sending assembly. This secondary device allows personnel at one of the locations to raise or lower material vertically, as well as transport material horizontally. For example, personnel at the location of the sending assembly, can mount the vertical lift assembly in the same, or a nearby, opening to lift materials that are then transported horizontally to the receiving location. Alternatively, material can be received horizontally, and then lowered to ground level.

The secondary or vertical lift assembly of the present invention may be used alone or in combination with the preceding primary or horizontal transport assembly, and is comprised of a lifting bar, a pair of clamping bars, adjustable feet, and locking means to secure the clamping bars in the desired position. The lifting bar has a forward end and a rear end, with line attachment, e.g., a pulley, or attachment unit for the pulley, at its forward end. As used herein, the term "line" is intended to cover ropes, cords, cables, and similar flexible lengths of materials.

The two clamping bar are essentially longitudinal bars having a length greater than the width of the opening to which the primary or vertical lift assembly is to be attached. Connectors secure the lifting bar transversely to the clamping bars, normally about the center of the clamping bars. Each connector may include a first tubular member through which the clamping bar is inserted, and a second tubular member, attached transversely to the first tubular member, through which the lifting bar is inserted. Pins or other locking means may be used to secure the bars in the desired positions.

When used, one clamping bar is placed on the exterior of the wall containing the opening, and the second clamping means is placed on the interior of the wall in a horizontal plane with the first clamping bar, so that the wall is sandwiched between the clamping bars. Pivotal feet may be attached to the ends of the clamping bars to provide a greater surface area for gripping the wall. The lifting bar is secured transversely to the clamping bars, so that the forward end of the lifting bar, and line attachment.

The clamping bars are then tightened against the sides of the wall with a clamping means. For example, at least one, and preferably two, elongated C-clamps can be used, with one face of each clamp being pressed against the exterior face of the outer clamping bar, and the other clamp face being pressed against the inner face of the inner clamping bar. The clamp faces may be of inwardly facing C-shape configurations with inner dimensions corresponding to the outer cross-sectional dimensions of the clamping bars for greater stability.

The vertical lift assembly may additionally include an attachment unit on the inner clamping bar to attach an anchoring line. Also, a winch may be located behind the vertical lift assembly, with the winch cable extending through the line attachment, so that the winch can be used for lifting objects from below. If the vertical lift assembly is used without assembling the horizontal transport assembly, the winch from the horizontal transport assembly can be used for this purpose.

Accordingly, one aspect of the present invention is to provide a portable transport apparatus that includes a sending assembly having bracing members positionable against the interior of a first wall on either side of a first opening, and a crossbar having outer ends attachable to the bracing members; a receiving assembly including bracing members positionable against the interior of a second wall on either side of a second opening, and a crossbar having outer ends attachable to the bracing members; a cable extendable from the sending assembly to the receiving assembly; and material support means adapted to be carried along the cable.

Another aspect of the present invention is to provide a vertical lifting device attachable within an exterior wall opening that includes a lifting bar having an inner end and an outer end, the outer end including a line guide means; an inner clamping bar positionable on the inner face of the wall; an outer clamping bar positionable on the outer face of the wall, with the lifting bar being attachable to said clamping bars so that the outer end of the lifting bar projects outwardly from the opening.

Still another aspect of the present invention is to provide an apparatus comprised of a combination of the above apparatus and device.

These and other aspects of the present invention will become apparent to those skilled in the art after a reading of the following description of the preferred embodiment.

BRIEF DESCRIPTION OF THE DRAWINGS

FIG. 5A is a perspective view of a pivotal foot to be attached to the beveled end of the leg extension illustrated in FIG. 5.

DETAILED DESCRIPTION OF THE INVENTION

Figure 1:
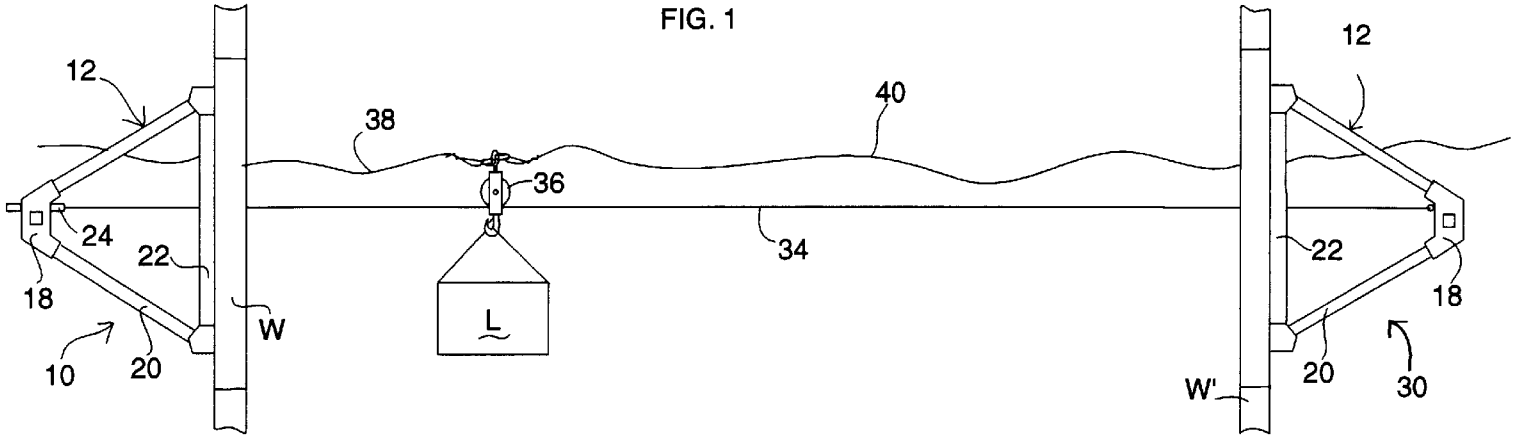
FIG. 1 is a schematic side view of the sending and receiving assemblies in use between two buildings.

In the following description, terms such as horizontal, upright, vertical, above, below, beneath, and the like, are used solely for the purpose of clarity in illustrating the invention, and should not be taken as words of limitation. It will be understood that the devices described herein are constructed of more than one of the components illustrated in the drawings. The drawings include only one illustration of each component, however, for brevity of illustration. Like components are given like numbering.

It should also be understood that the drawings are for the purpose of illustrating the invention and are not intended to be to scale. In particular, the distance between the sending and receiving assemblies in FIGS. 1 and 2 is greatly foreshortened to better illustrate the relationship between the assemblies.

Figure 2:
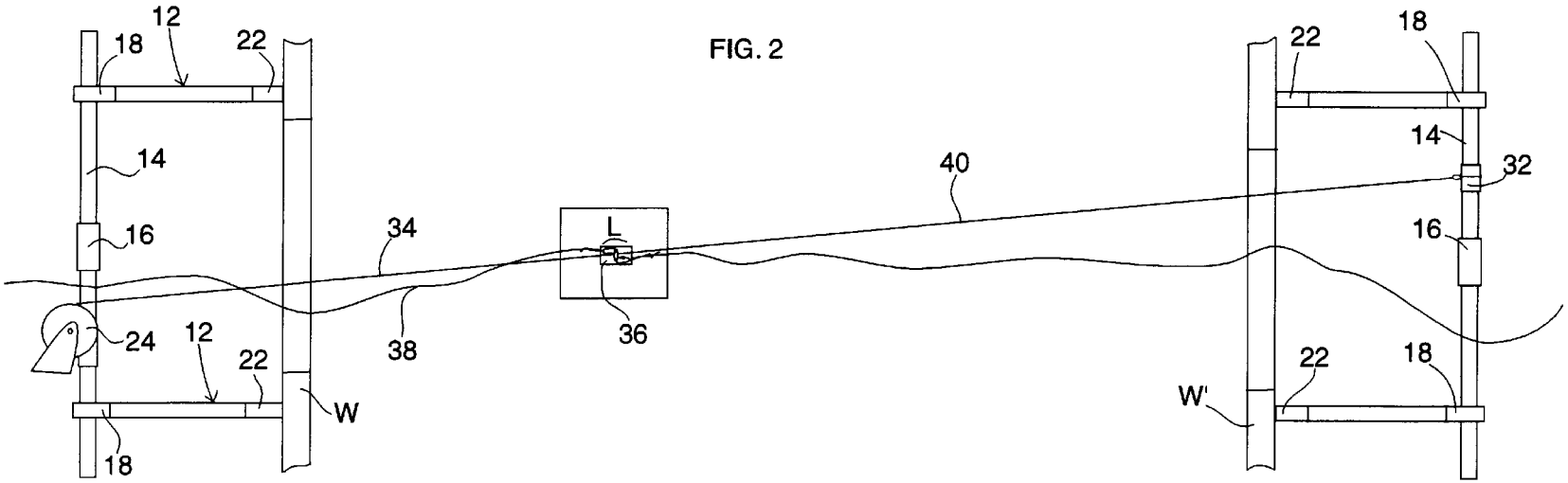
FIG. 2 is a schematic top view of the sending and receiving assemblies in use between two buildings.
Figure 3:
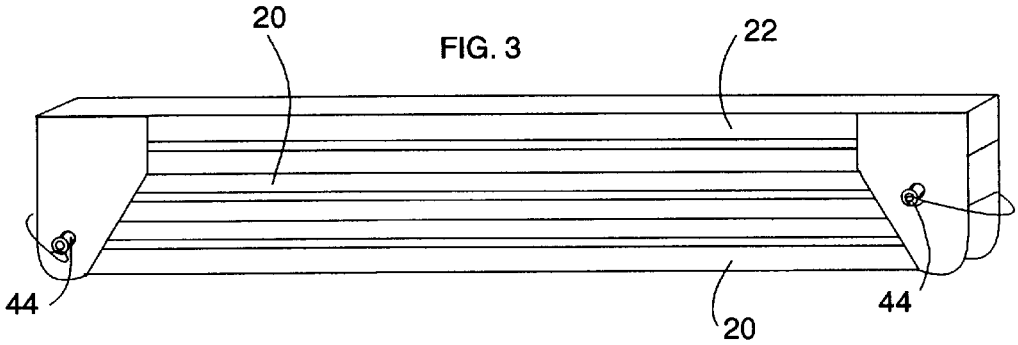
FIG. 3 is a perspective view of the base and legs of a brace member folded for packing, as used for both the sending and receiving assemblies.
Figure 4:
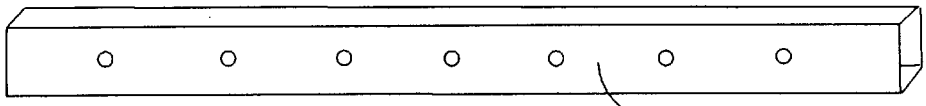
FIG. 4 is a perspective view of a crossbar as used for both the sending and receiving assemblies.
Figure 5:
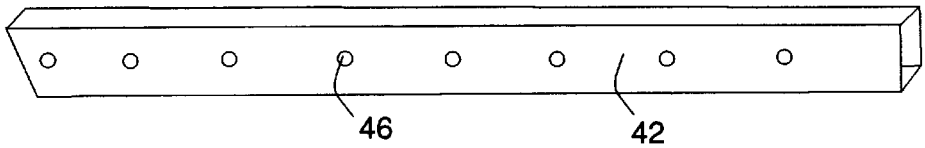
FIG. 5 is a perspective view of a leg extension used with either of the assemblies when the assembly is employed for vertical lifting.
Figure 5:
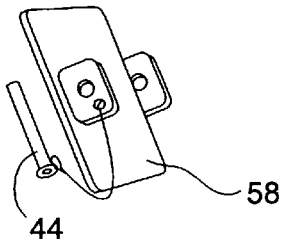
Figure 6:
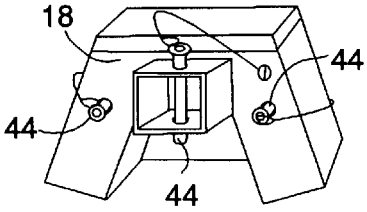
FIG. 6 is a perspective view of a connector cap used in both sending and receiving assemblies.
Figure 7:
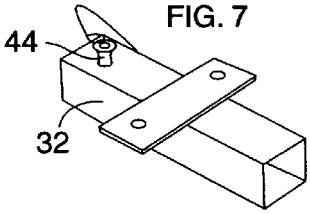
FIG. 7 is a perspective view of the cable attachment unit used with the receiving assembly,.
Figure 8:
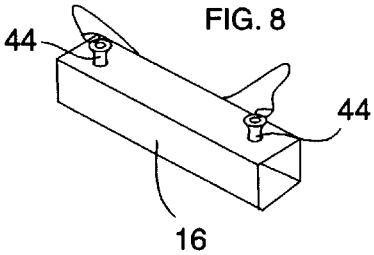
FIG. 8 is a perspective view of a connector sleeve used to join abutting ends of two crossbars.
Figure 9:
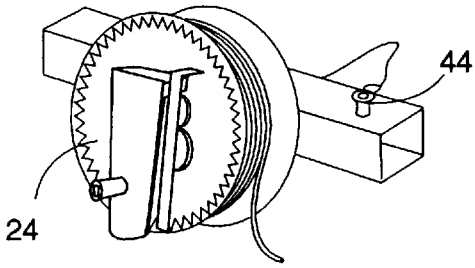
FIG. 9 is a perspective view of a winch used with the sending assembly.

As best illustrated in FIGS. 1 and 2, the sending assembly, Generally 10, is comprised of a pair of triangular brace members 12 joined at their apexes by connected crossbars 14. A connector sleeve 16 joins crossbars 14 at their abutting ends. Connector caps 18 joint the upper ends of legs 20 of brace member 12. The base 22 of each brace member 12 is positioned against the inner face of a wall (W), with one brace member 12 being positioned on either side of a wall opening. A winch 24 is mounted on a crossbar 14.

Receiving assembly, generally 30, is similarly comprised of a pair of triangular brace members 12 joined at their apexes by connected crossbars 14. As with sending assembly 10, a connector sleeve 16 joins crossbars 14 at their abutting ends, and connector caps 18 join the upper ends of legs 20 of brace member 12. The base 22 of each brace member 12 of receiving assembly 30 is positioned against the inner face of a another wall (W'), with one brace member 12 being positioned on either side of a wall opening. A cable attachment unit 32 is mounted on a crossbar 14.

Cable 34 extends from winch 24 to attachment unit 32 to form an overhead trackway for pulley 36. Ropes 38 and 40 extend from pulley 36 to assemblies 10 and 30, so that pulley 36 and a supported load (L) can be moved between the assemblies.

As noted in the summary of the invention, either assembly 10 or 30 may be used as a vertical lifting assembly by rotating the assembly 90° and positioning crossbar 14 over the item to be lifted. If the surface upon which the assembly is placed is uneven. base 22 can be replaced by extension legs 42, which are slidable onto assembly legs 20. The components of assemblies 10 and 30 are illustrated in FIGS. 3–9. These components include locking pins 44 that can be inserted into aligned holes 46 to secure the components together to form the desired assemblies. The lower ends of leg extensions 42 can be fitted with pivotal feet 58. Leg extensions 44 are braced with horizontal brace 64.

Figure 10:
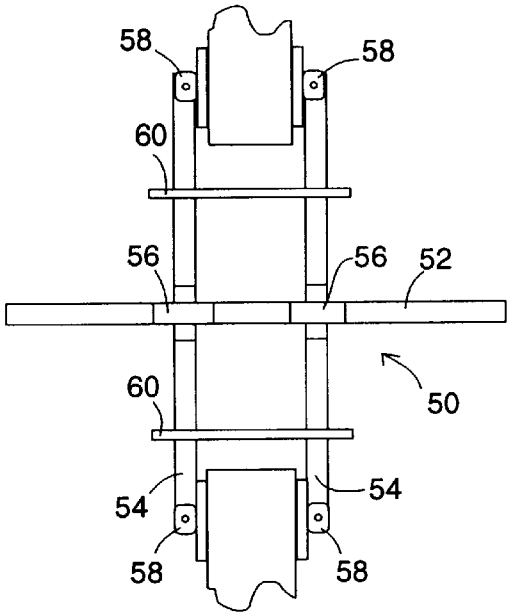
FIG. 10 is an overhead view of a vertical lifting assembly.
Figure 11:
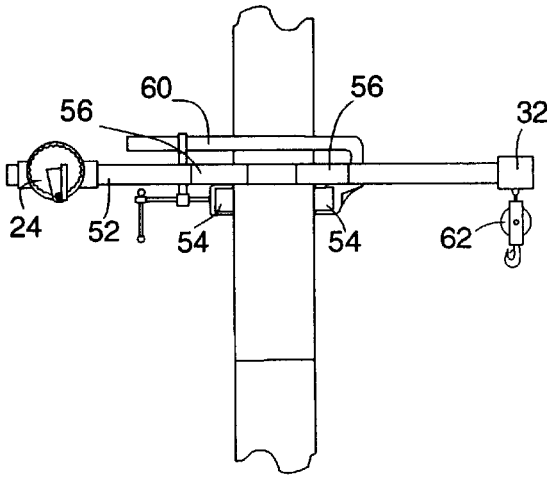
FIG. 11 is a sectional side view of the vertical lifting assembly shown in FIG. 10.
Figure 12:
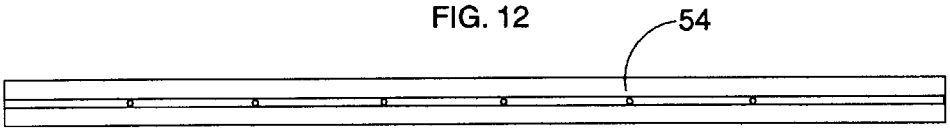
FIG. 12 is a clamping bar forming a part of the vertical lifting assembly.
Figure 13:
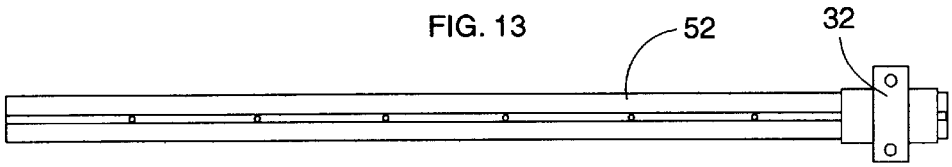
FIG. 13 is a lifting bar forming a part of the vertical lifting assembly.
Figure 14:
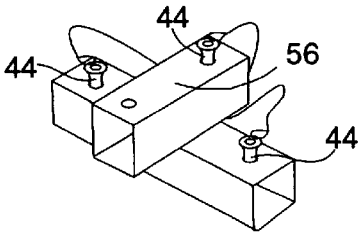
FIG. 14 is a connector sleeve forming a part of the vertical lifting assembly.
Figure 15:
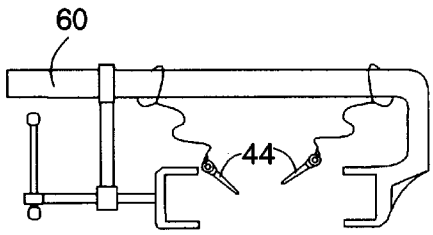
FIG. 15 is a clamp forming a part of the vertical lifting assembly.
Figure 16:
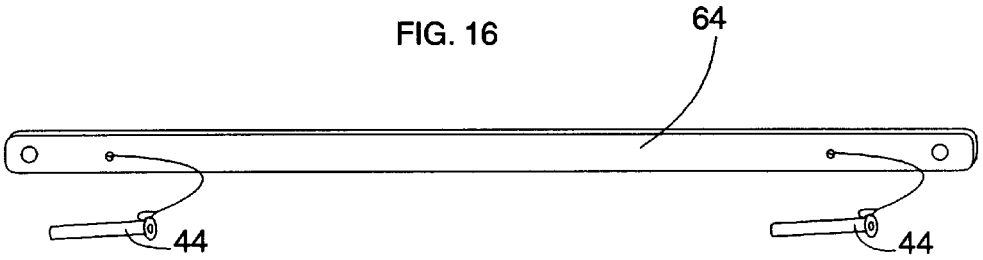
FIG. 16. is a front view of a horizontal bar used to brace the legs of the vertical assembly illustrated in FIG. 17.

The assembled vertical lift assembly, generally 50, illustrated in FIGS. 10 and 11, uses the same components as 10 and 30. Lift 50 is comprised of a lifting bar 52, four clamping bars 54 with pivotal feet 58, cross-connector sleeves 56, and clamps 60. Bars 52 and 54 may be identical to each other and to bar 14, and may be used interchangeably. However, the bars are designated by different numbers for clarity of description.

When assembled, bar 52, with attachment unit 32 at it outer end, extends outwardly from an opening in a wall (W). Bar 52 is slidably attached to clamping bars 54 by cross-connector sleeves 56. One of the clamping bars 54 is on the outside of wall W, while the other clamping bar 54 is on the inside of wall W. Feet 58 are attached to the ends of bars 54 so that the feet pad surfaces engage wall W. Clamps 60 force bars 54 together, pressing feet 58 against the sides of wall W to hold lift assembly 50 in position. A pulley 62 or original snatch block 36 can be attached to attachment unit 32.

As will be apparent from the drawings, the sending and receiving assemblies can be used to transport materials across the elevated cable trackway from one building to another. These assemblies may also be used in a similar manner to transport materials between other elevated locations, and along pathways that are at an angle from horizontal.

Figure 17:
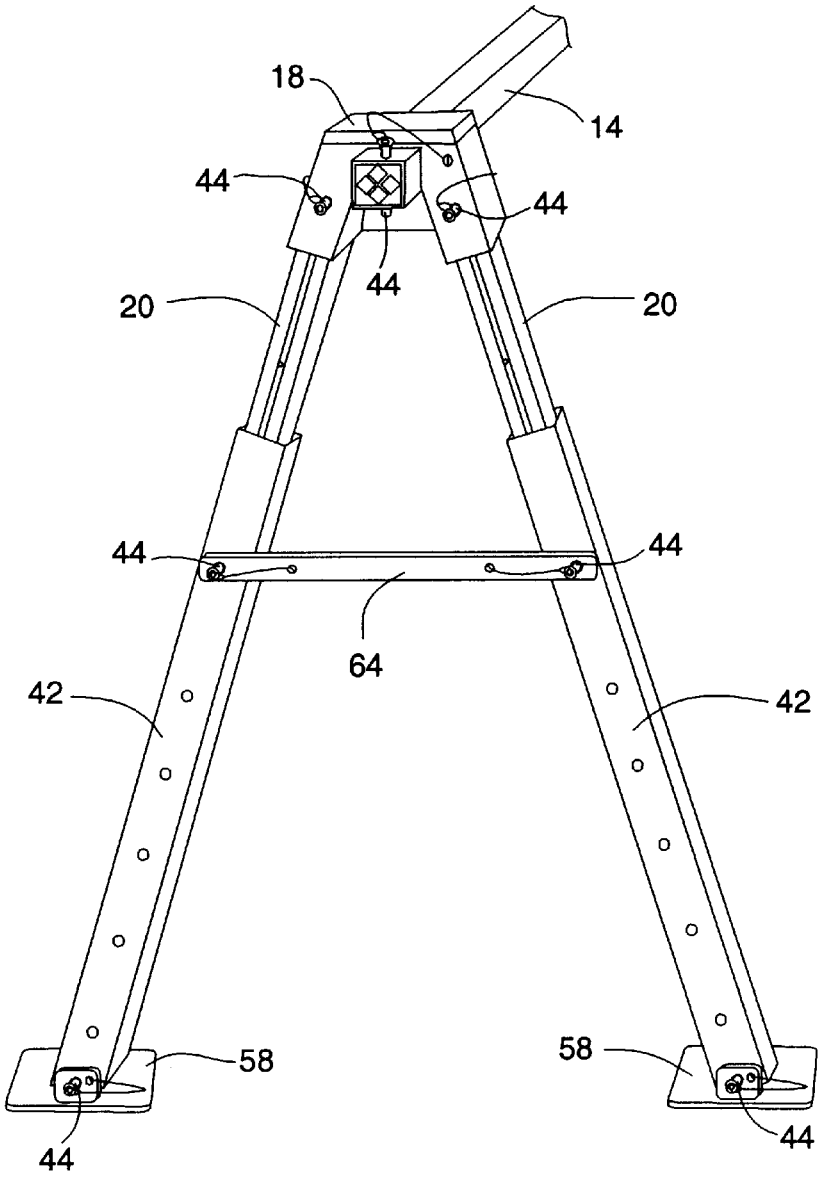
FIG. 17 is a perspective view of one end of a vertical lift assembly formed from some of the components illustrated in earlier figures.

Also, as illustrated in FIG. 17, one of the assemblies can be used as a vertical lift assembly. An identical support assembly is positioned at the other end of horizontal bar 14. Alternatively, the sending and receiving assemblies can be converted to the vertical lift assembly of the type illustrated in FIGS. 10–11 to lift materials vertical, and then transport the material along a generally horizontal pathway.

After reading the preceding description, it will be apparent that the present device can be easily transported, and quickly assembled to provide a means for moving materials along an elevated and/or vertical pathway without exposure of operating personnel to risk.

Certain modifications and improvements will occur to those skilled in the art upon a reading of the foregoing description. It should be understood that all such modifications and improvements have been deleted herein for the sake of conciseness and readability but are properly within the scope of the follow claims.

What is claimed is:

1. A portable apparatus for use in transporting material along an elevated pathway between a first building including a first wall with an interior face and a first opening, and a second building including a second wall with an interior face and a second opening, said apparatus comprising:

a) a sending assembly including bracing members for positioning against the interior face of said first wall on either side of said first opening, and a crossbar having outer ends attachable to said bracing members;

b) a receiving assembly including bracing members for positioning against the interior face of said second wall on either side of said second opening, a crossbar having outer ends attachable to said bracing members, the bracing members of said sending and receiving assemblies including a base for positioning against the interior face of each wall, said base having outer ends, legs extending from the outer ends of the base, said legs having distal ends joined by a connector;

c) a cable extendable from said sending assembly to said receiving assembly; and d) material support means adapted to be carried along said cable.

2. The apparatus of claim 1, wherein the crossbar of each assembly is joined to each bracing member at said connector.

3. The apparatus of claim 1, wherein said receiving assembly includes a cable attachment means for securing the end of said cable to said crossbar.

4. The apparatus of claim 1, wherein said legs are telescoping extension legs.

5. The apparatus of claim 4, further including bracing members having opposing ends attachable to said extension legs.

6. A vertical lifting device attachable within an exterior wall having an inner face, an outer face and an opening comprising:

a) a lifting bar having an inner end and an outer end, said outer end including a line guide means;

b) an inner clamping bar positionable on the inner face of said wall;

c) an outer clamping bar positionable on the outer face of said wall in a horizontal plane with, and parallel to, said inner clamping bar, said lifting bar being attachable to said clamping bars.

7. The lifting device of claim 6, further including connectors for joining said lifting bar transversely to said clamping bars.

8. The lifting device of claim 6, further including clamps to hold said clamping bars against said wall.

9. The lifting device of claim 8, wherein said clamps are C-clamps.

10. The lifting device of claim 7, wherein said connectors include a first sleeve and a second sleeve transversely positioned relative to said first sleeve, said lifting bar being slidable within said first sleeve, and one of said clamping bars being slidable within said second sleeve.

11. The lifting device of claim 6, further including a winch at the inner end of said lifting bar.

12. The lifting device of claim 6, wherein said line guide means is a pulley.

13. The lifting device of claim 6, further including feet at the ends of each of said clamping bars to engage said wall.

14. A portable apparatus for use in transporting material along horizontal and vertical pathways comprising:

a) a sending assembly including bracing members positionable in a first building against the interior of a first wall on either side of a first opening, and a crossbar having outer ends attachable to said bracing members;

b) a receiving assembly including bracing members positionable in a second building against the interior of a second wall on either side of a second opening, and a crossbar having outer ends attachable to said bracing members;

c) a cable extendable from said sending assembly to said receiving assembly;

d) material support means adapted to be carried along said cable; and e) a vertical lifting assembly attachable within a wall opening in one of said buildings, said lifting assembly including a lifting bar with an inner end and an outer end having a line guide means, and inner and outer clamping bars positionable on opposite sides of said wall and across said opening, said lifting bar being attachable to said clamping bars, whereby said lifting bar outer end projects outwardly from said wall.

15. The apparatus of claim 14, wherein the bracing members of said sending and receiving assemblies include a base positionable against a wall interior face, said base having outer ends, legs extending from the outer ends of the base, said legs having distal ends joined by a connector.

16. The apparatus of claim 14, further including connectors for joining said lifting bar transversely to said clamping bars, and clamps to hold said clamping bars against said wall.

17. A portable apparatus for use in transporting material along an elevated pathway between a first building including a first wall with an interior face and a first opening, and a second building including a second wall with an interior face and a second opening, said apparatus comprising:

a) a sending assembly including bracing members for positioning against the interior face of said first wall on either side of said first opening, and a first crossbar having outer ends attachable to said bracing members;

b) a receiving assembly including bracing members for positioning against the interior face of said second wall on either side of said second opening, a second crossbar having outer ends attachable to said bracing members, said first and second crossbars each including two axially aligned sections with abutting ends joined by a connector;

c) a cable extendable from said sending assembly to said receiving assembly; and d) material support means adapted to be carried along said cable.

18. A portable apparatus for use in transporting material along an elevated pathway between a first building including a first wall with an interior face and a first opening, and a second building including a second wall with an interior face and a second opening, said apparatus comprising:

a) a sending assembly including bracing members for positioning against the interior face of said first wall on either side of said first opening, and a crossbar having outer ends attachable to said bracing members, said sending assembly including a winch attachable to said crossbar;

b) a receiving assembly including bracing members for positioning against the interior face of said second wall on either side of said second opening, and a crossbar having outer ends attachable to said bracing members;

c) a cable extendable from said sending assembly to said receiving assembly, said cable being deployed from said winch; and d) material support means adapted to be carried along said cable.

19. A portable apparatus for use in transporting material along an elevated pathway between a first building including a first wall with an interior face and a first opening, and a second building including a second wall with an interior face and a second opening, said apparatus comprising:

a) a sending assembly including bracing members for positioning against the interior face of said first wall on either side of said first opening, and a crossbar having outer ends attachable to said bracing members;

b) a receiving assembly including bracing members for positioning against the interior face of said second wall on either side of said second opening, a crossbar having outer ends attachable to said bracing members;

c) a cable extendable from said sending assembly to said receiving assembly; and d) a pulley adapted to be carried along said cable, said pulley including a first material attachment member and a guide line attachment member, and guide lines for attachment to said guide line attachment member to pull said pulley along said cable.

20. The apparatus of claim 19, wherein the bracing members of said sending and receiving assemblies include a base positionable against a wall interior face, said base having outer ends, legs extending from the outer ends of the base, said legs having distal ends joined by a connector.

21. The apparatus of claim 19, wherein the crossbar of each assembly is joined to each bracing member at said connector.

22. The apparatus of claim 19, wherein said crossbar is comprised on two axially aligned sections with abutting ends joined by a connector.

23. The apparatus of claim 19, wherein said sending assembly includes a winch attachable to said crossbar, said cable being deployed from said winch.

24. The apparatus of claim 19, wherein said receiving assembly includes a cable attachment means for securing the end of said cable to said crossbar.

* * * * *